US008920217B2

(12) United States Patent
Panzenhagen et al.

(10) Patent No.: US 8,920,217 B2
(45) Date of Patent: Dec. 30, 2014

(54) BLADE AND WHEEL PLATE FOR BLAST CLEANING WHEEL AND METHOD OF CONNECTING A BLADE TO THE WHEEL PLATE

(75) Inventors: Carl Panzenhagen, New Berlin, WI (US); Steve Bothe, Waukesha, WI (US)

(73) Assignee: CP Metcast, Inc., New Berlin, WI (US)

( * ) Notice: Subject to any disclaimer, the term of this patent is extended or adjusted under 35 U.S.C. 154(b) by 0 days.

(21) Appl. No.: 13/261,750

(22) PCT Filed: Apr. 2, 2012

(86) PCT No.: PCT/US2012/031866

§ 371 (c)(1),
(2), (4) Date: Sep. 27, 2013

(87) PCT Pub. No.: WO2012/135836

PCT Pub. Date: Oct. 4, 2012

(65) Prior Publication Data

US 2014/0038498 A1 Feb. 6, 2014

Related U.S. Application Data

(60) Provisional application No. 61/470,877, filed on Apr. 1, 2011.

(51) Int. Cl.
*B24B 5/06* (2006.01)
*B24C 5/06* (2006.01)

(52) U.S. Cl.
CPC .. *B24C 5/06* (2013.01); *B24C 5/062* (2013.01)
USPC ..... 451/97; 451/98

(58) Field of Classification Search
CPC ..... B24C 5/06; B24C 5/062
USPC ..... 451/97, 95, 96, 98
See application file for complete search history.

(56) References Cited

U.S. PATENT DOCUMENTS

| | | | | |
|---|---|---|---|---|
| 4,649,673 | A * | 3/1987 | Van Huyssteen | 451/97 |
| 5,209,024 | A * | 5/1993 | Carpenter et al. | 451/95 |
| 5,476,412 | A * | 12/1995 | Stoltz | 451/75 |
| 5,759,091 | A * | 6/1998 | MacMillan | 451/95 |
| 2003/0002987 | A1 * | 1/2003 | Davidson | 416/198 A |

* cited by examiner

*Primary Examiner* — Robert Rose
(74) *Attorney, Agent, or Firm* — Wozny Law, LLC; Thomas M. Wozny

(57) ABSTRACT

A method and apparatus for connecting a blade to a single sided wheel plate or a pair of interconnected wheel plates. The assembly provides a repeatable, positive and even positioning location for each blade. It utilizes an ellipse that tapers outwardly from the center of the wheel along the blade connecting member that corresponds with the connecting channel on the wheel. The ellipse provides for equal and uniform contact on the entire blade connection to firmly hold the blade in place without parallel surfaces. The ellipse design provides a measured and increasing improved release in that all surfaces of the ellipse are tapered with non-parallel surfaces such that blade retention and blade removal is dramatically simplified.

14 Claims, 9 Drawing Sheets

BLADE AND WHEEL PLATE FOR BLAST CLEANING WHEEL AND METHOD OF CONNECTING A BLADE TO THE WHEEL PLATE

BACKGROUND OF THE INVENTION

The present invention relates to throwing wheels, sometimes referred to as blasting wheels or shotblast wheels, used to project streams of particles against work pieces to subject the work pieces to cleaning, abrading or peening action or the like. A typical wheel of this kind is shown in U.S. Pat. No. 5,476,412. Among the objects of the present invention is an improved apparatus for and method of connecting blades to a single wheel plate or to a set of interconnected wheel plates for a centrifugal blasting wheel.

Airless centrifugal throwing wheels of the type described consist of a single or double wheel plate having a number of blades extending radially from the wheel plate(s) in equally circumferentially spaced apart relation, with a means of removable securing the blades between the wheel plate(s). In operation, the bladed wheel is rotated at high speed about a central axis and abrasive particulate material is fed onto the inner portions of the blade whereby the material is displaced by centrifugal force outwardly over the surface of the blades and projected at high velocity from the ends of the blades.

Blades of this type typically wear out under the abrading effects of the particles that are thrown. These abrasive particles move along the blades and gradually wear out portions of the throwing wheel as well as the blades themselves. Further when the particulate that is being used needs to be changed to a different material either in abrasiveness or otherwise, or when the blades become worn, the blades need to be removed and the equipment needs to be reset.

Because of the tolerances of blade casting, as well as wearing of the channel slot in the wheel and connecting member projecting from the blade through use, the channel slot is or becomes larger than the blade connecting member. This results in a sloppy fit of the blade to the wheel allowing minute particulate to work its way into the blade mounting channel which tends to seize the blade to the throwing wheel, typically referred to in the industry as "shot locking".

This "shot-locking" makes removal of the Blades difficult and includes potential safety issues as the blades may require substantial force to remove. Typically in order to remove a prior art blade, significant downward striking force is required, such as with a hammer. blades are typically constructed of cast white iron or high chrome iron, which is very brittle, and can crack or chip when struck. These chips at times "splinter" and can cause safety issues for operators and/or damage to other wheel components.

In many prior designs, blades must be "hammered" out of the corresponding wheel channel the entire length of the blade locking connection before the blade can be removed.

Many connecting methods have been devised to attach blades to wheel plates. Some methods requires pins, springs or other mechanical locking devices. One such method is disclosed in U.S. Pat. No. 2,869,289 which utilizes leaf springs to attach the blades to the wheel. The prior art also used a stop member that was inserted through the wheel to prevent the blades from moving radially outward. In addition to stopping the blade from movement, the stop members are used to properly position the blades in the wheel to allow for proper balancing of the rotating wheel. Because of the complexity and precision needed to properly install the blades, installation of the blades in the prior art is time consuming and difficult. Further the stop member is subject to failure and damage more quickly then the surrounding structure.

Another such connecting method is described in U.S. Pat. No. 5,476,412. The prior art utilizes a simple dove tail design that narrows along the blade connecting member, that corresponds with the connecting channel to the outer section of the rotating wheel. The centrifugal outward force keeps the blades in place while the wheel rotates. The prior art uses a trapezoidal design that creates parallel surfaces between the blade and wheel. The prior art design requires the blade to "wedge" into the "V" groove channel of the wheel. Due to difficulty in casting this prior art blade, actual blade location in the wedge can vary causing the wheel to be imbalanced even with new blades. As with other prior art, this design also suffers from issues of "shot-locking" as described above.

SUMMARY OF THE INVENTION

The disadvantages of prior art can be overcome by providing a method of equal and continuous non-parallel contact between blade and wheel plate surfaces and eliminating parallel surfaces that cause blades to become "shot-locked" with abrasive grit.

Additionally, the blade and wheel are both cast with a repeatable and positive locating position for the blade within the wheel channel insuring proper wheel balance at high rotational speeds of up to 3600 rpm.

The wheel apparatus is provided with a plurality of blade elements having a tapered "ellipse" shape in the cross section beginning with a larger ellipse at the center radiating out to a smaller ellipse near the out diameter of the wheel. Each blade is provided with a similar tapered ellipse that slides into an equally tapered elliptical wheel slot channel of the wheel providing the desired equal and continuous contact between the wheel apparatus and the blade(s).

In a preferred embodiment, the invention is directed toward an interlocking joint connection between the wheel plate and wheel blade. The joint includes a frustum-shaped radially extending channel or mortise formed in the wheel and a corresponding frustum-shaped tenon projecting from the blade. Both the mortise and tenon have a longitudinal axis extending radially from the axis of rotation of the wheel and an elliptically-shaped cross section, and both are tapered so that their radially inner end has a greater cross sectional area than their radially outer end.

When blade removal is required, the mating tapered ellipse(s) of blade and wheel channel provide a measured and increasingly improved release in that all distances between the blade and the wheel channel slot continually increase as the blade is slid further out of the wheel channel slot from the locked position to the center removal position.

Wherein, the wheel plate(s) has an elliptical tapered channel slot extending from the center area of the wheel to the outer diameter.

Wherein, the elliptical channel slot has an opening that is larger at the inner portion of the wheel and tapering in a continual ellipse equally with the wheel plate(s) on all surfaces to a lesser opening near the outer portion of the wheel.

Wherein, the blade(s) are cast with an equally tapered ellipse, larger at the feed end and smaller at the exit end, matching the continually tapered ellipse channel slot(s) of the wheel plate.

Wherein, the blade ellipse is positioned into the wheel elliptical channel slot providing an equal and continuously tapered connection with no parallel surfaces between the blade and wheel plate(s).

Wherein, the elliptical blade connecting means corresponds to the elliptical channel slot on the wheel plate(s).

Wherein the casting process of the ellipse blade and wheel channel design eliminates parallel flat surfaces that can cause shot locking between the blade and wheel channel slot(s).

Wherein, the ellipse blade design has a positive blade position within the ellipse channel slot that is repeatable due to casting process and design.

Accordingly, in one aspect, the present invention provides a centrifugal blasting wheel comprising:

a rotatable annular wheel plate having a radially extending planar face, an inner periphery, an outer periphery, and a plurality of radially extending channels formed in said face and disposed equally spaced circumferentially around the wheel plate wherein each channel has an inner end and an outer end and wherein each channel has a cross sectional shape with a width and a height such that the width and the height of the channel is less at the outer end of the channel than the width and height at the inner end of the channel and each channel further has an arcuate concave shaped bottom surface and an arcuate concave shaped top surface;

a blade releasably disposed in each channel wherein each blade has a connecting member extending radially along one blade edge, said connecting member having a cross sectional shape and taper corresponding to the cross sectional shape and taper of the wheel plate channels.

Preferably, the cross sectional shape of the channel is an ellipse.

In another aspect, the present invention provides a blade releasably connectable to a wheel plate of a centrifugal blasting wheel, comprising:

a blade member having a side edge;

a connecting member integral with and depending from the side edge of said blade member, said connecting member having an inner end and an outer end and further having a cross sectional shape with a width and a height such that the width and height of the connecting member is less at the outer end of the connecting member than the width and height at the inner end of the connecting member; and the connecting member has an arcuate convex shaped bottom surface and an arcuate convex shaped top surface.

Preferably, the cross sectional shape of the connecting member is an ellipse.

DETAILED DESCRIPTION OF THE PREFERRED EMBODIMENTS OF THE INVENTION

Figure 1:
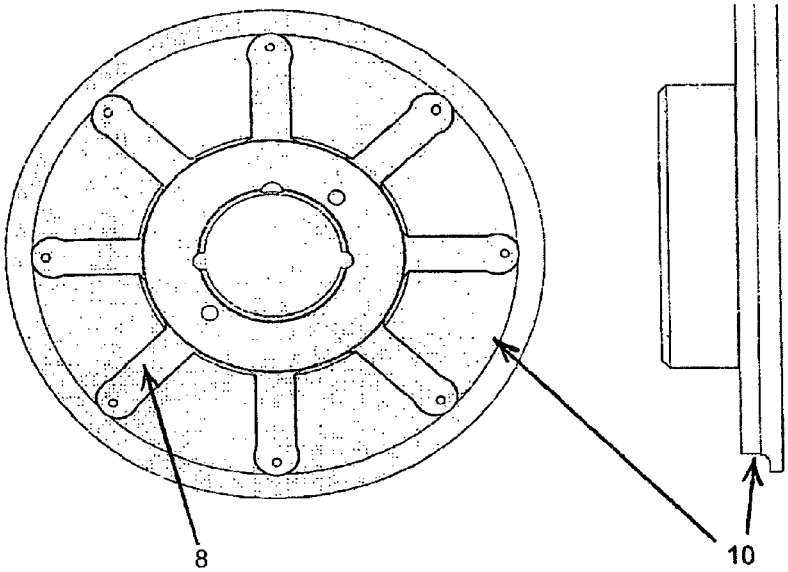
FIG 1. Prior Art
FIG. 1 is a view of prior art single wheel plate.
Figure 2:
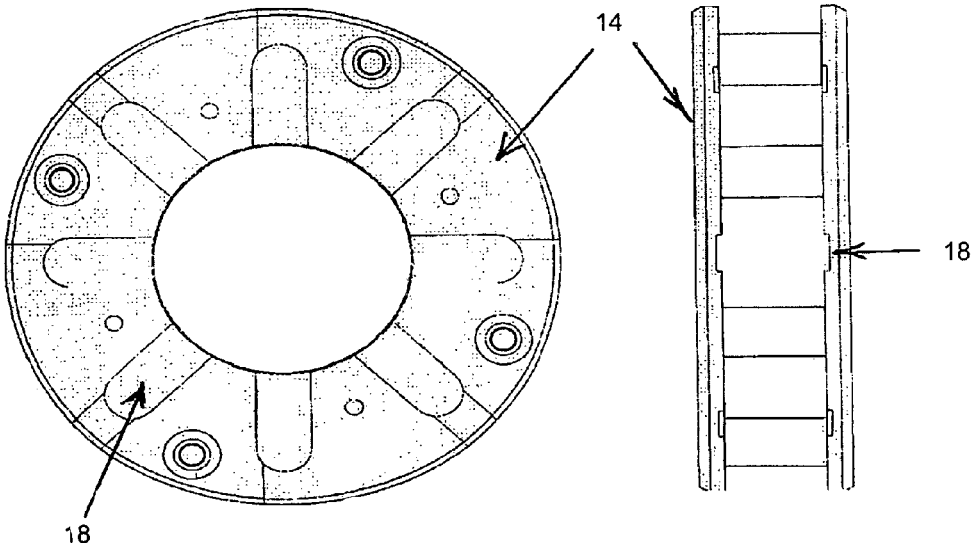
FIG. 2 Prior Art
FIG. 2 is a view of prior art dual wheel plate.
Figure 3:
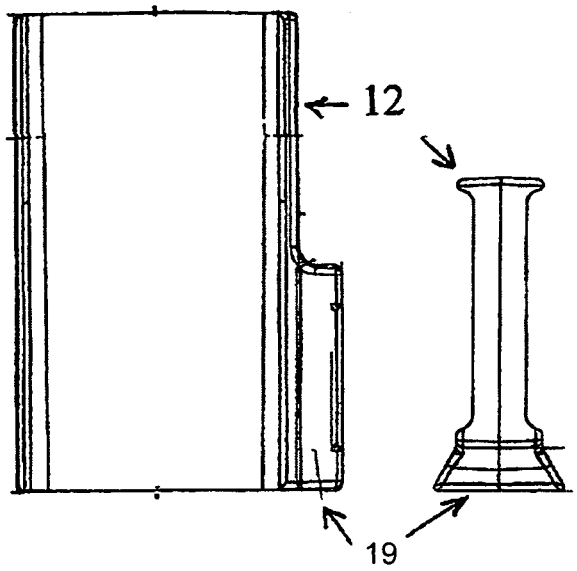
FIG. 3 is a view of prior art single wheel blade.
Figure 4:
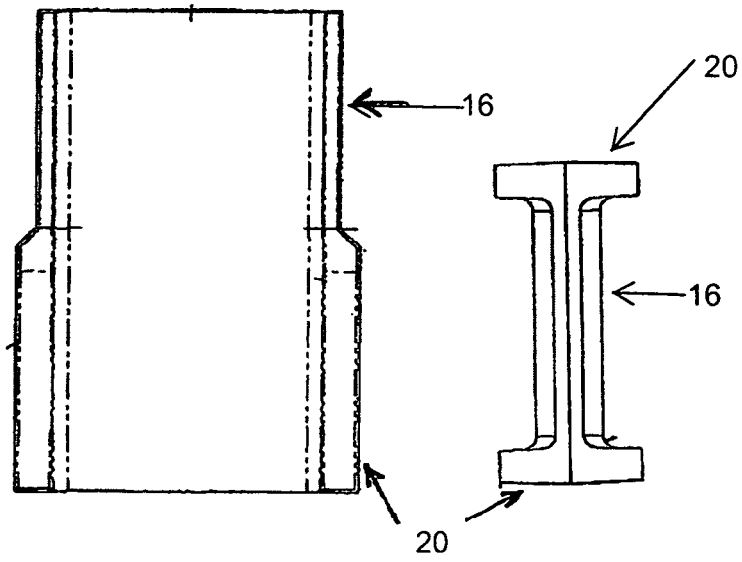
FIG. 4 is a view of prior art dual wheel blade.

Typical forms of prior art blades 12 and 16 are shown in FIG. 3 and FIG. 4 with corresponding typical prior art wheel plates 10 and 14 shown in FIG. 1 and FIG. 2, respectively. The wheel plates 10 and 14 each have eight radial channels 8 and 18 equally spaced circumferentially around the wheel plates 10 and 14, respectively. The blade 12 has a connecting member or tenon 19 along one side of the edge of the blade 12. The blade connecting member 19 has a trapezoidal cross sectional shape with flat or planar outer surfaces which in this case remains dimensionally constant in size, cross sectional area, and shape along the entire length of the connecting member.

The blade 12 is typically inserted from the inner central portion of the wheel plate 10 and moved or slid radially outwardly so that tenon 19 slidably engages channel or mortise 8 to form an interlocking joint.

Another typical form of prior art wheel plate is shown in FIG. 2 and is referred to as a dual sided wheel plate 14. This wheel plate 14 also has eight radial channel slots 18. The prior art blade 16 in FIG. 4 shows two connecting members 20 located on each edge of the blade 16 that correspond to the prior art wheel plate channel slots 18. The blade connecting members 20 each have a rectangular cross sectional shape with flat or planar outer surfaces which remain dimensionally constant in size, cross sectional area, and shape along the entire length of the connecting members 20.

Referring now to FIGS. 5 through 15, the improved apparatus for and method of connecting blades to a single or dual wheel plate of a centrifugal blasting wheel in accordance with present invention will now be described.

Figure 5:
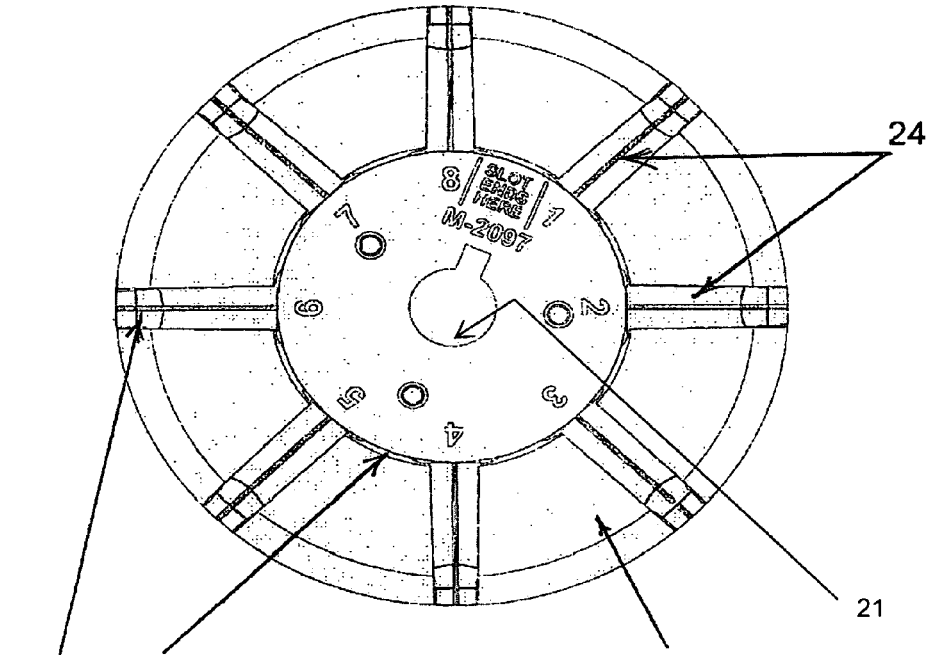
FIG. 5 is a front view of the preferred embodiment of a wheel plate of the present invention (single plate)
Figure 5A:
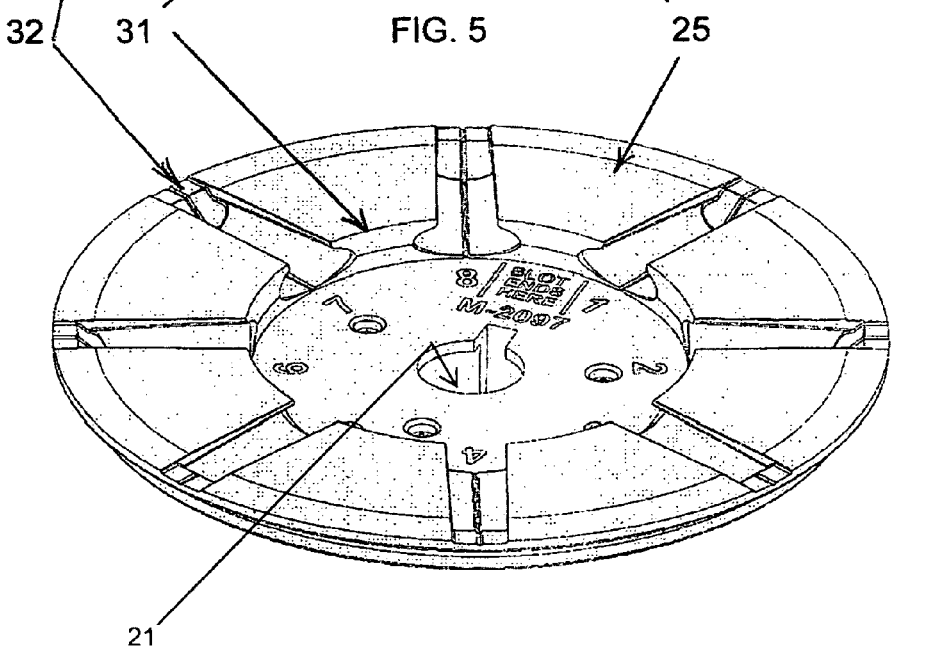
FIG. 5A is a perspective view of the single wheel plate of FIG. 5.
Figure 6:
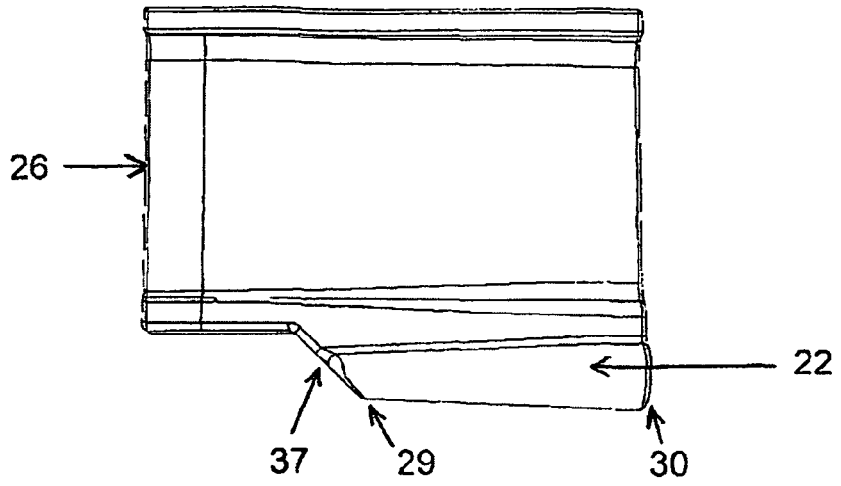
FIG. 6 is a side view of a tenon depending from a wheel blade forming one component of an interlocking joint between the blade and the wheel plate.
Figure 7:
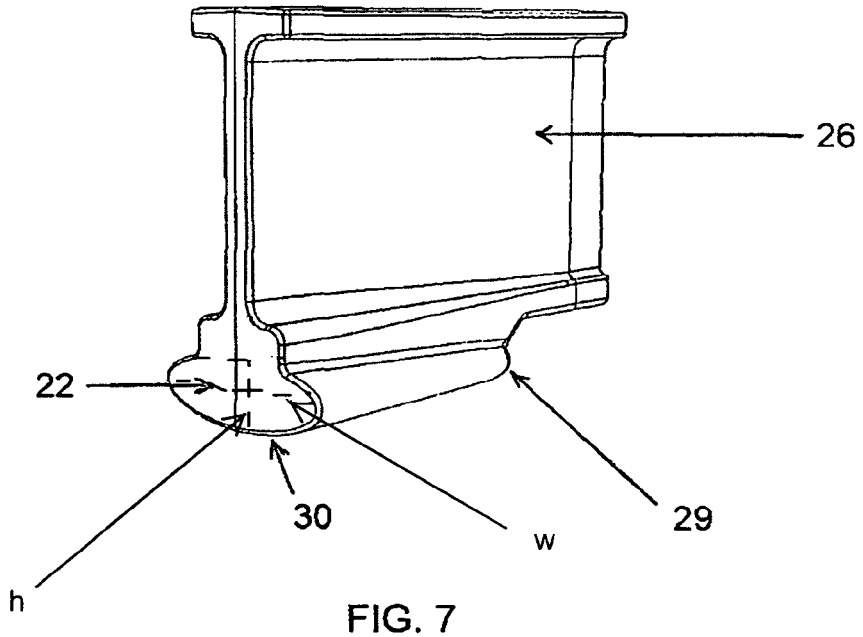
FIG. 7 is a perspective view of the tenon on the blade of the invention.

The preferred embodiment of the wheel plate of the present invention is shown in FIGS. 5 and 5A. The wheel plate 25 has eight radial channels or mortises 24 equally spaced circumferentially around the rotational axis defined by central opening 21. Mortises or channel slots 24 are located in a manner similar to prior art wheel plates except for the configurational changes described and shown herein. The differences arise in the connecting methodology or interlocking joint between the blade 26 and the wheel plate(s) 25.

Figure 10:
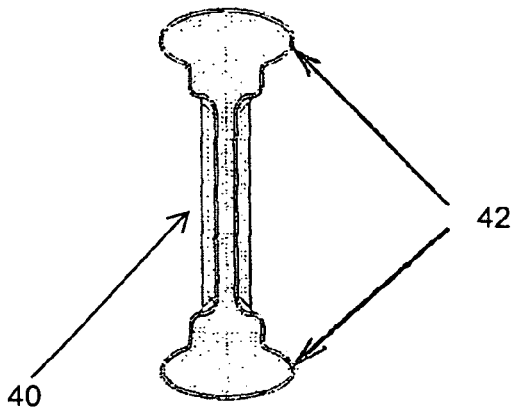
FIG. 10 is an end view of a dual ellipse blade.
Figure 11:
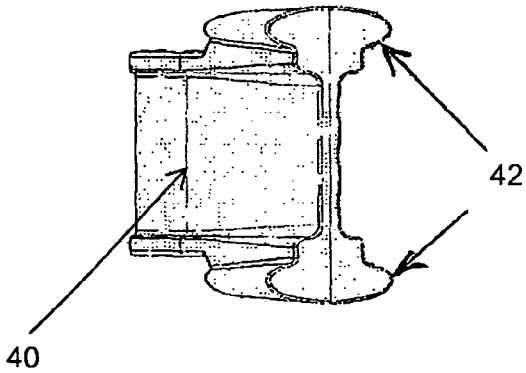
FIG. 11 is a perspective view of the dual ellipse blade.
Figure 12:
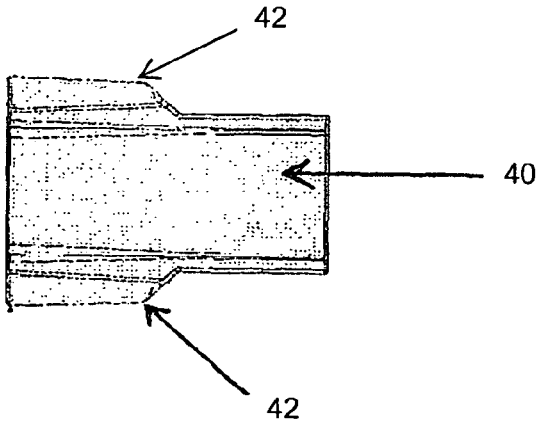
FIG. 12 is a side view of the dual ellipse blade.

The preferred embodiment of the blade 26 of the present invention used with a single sided wheel plate is shown in FIGS. 6, 7, 14 and 15. The preferred embodiment of the blade 27 using a double sided wheel plate is shown in FIGS. 10, 11 and 12.

The preferred embodiments of the blades 26, 27 have a blade to wheel channel slot connecting member or members located at the longitudinal side edge(s) thereof. The invention utilizes a blade connecting member or tenon 22 of a continually tapering ellipse design in that the radially outer end 29 of the tapered tenon is lesser in cross sectional area than the tapered radially inner end 30 tenon. Thus, both the height (h) and width (w) of tenon 22 is greater at inner end 30 than at outer end 29.

Figure 8:
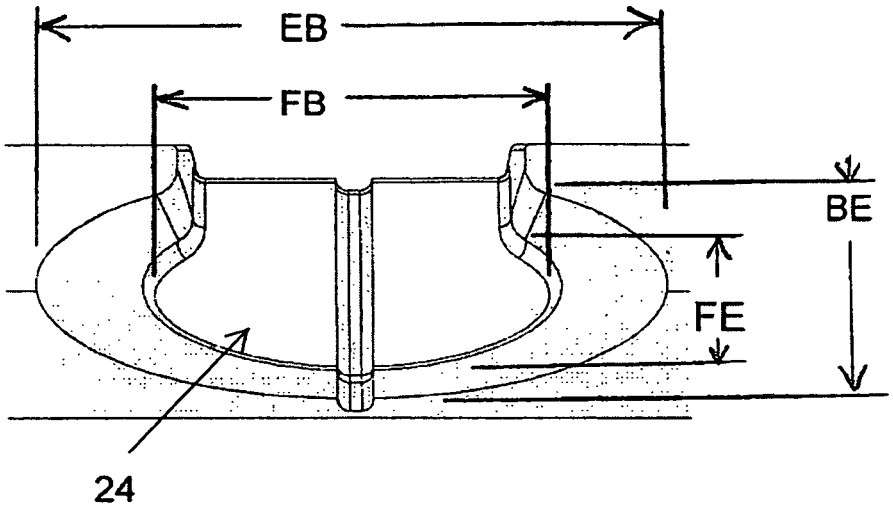
FIG. 8 is a the end view of a wheel channel forming the other component of the interlocking joint.

The preferred embodiment of the wheel plate channel(s) or mortise 24 is shown in FIG. 8. The wheel slot channel 24 has a corresponding elliptical taper matching the blade connecting member or tenon 22 shown in FIG. 6 and FIG. 7. The wheel slot channel(s) 24 extends radially from an inner periphery 31 formed by a central recessed portion in the radially extending planar face of the wheel plate 25 to a location near the outer end 32 of the wheel plate 25.

Figure 13:
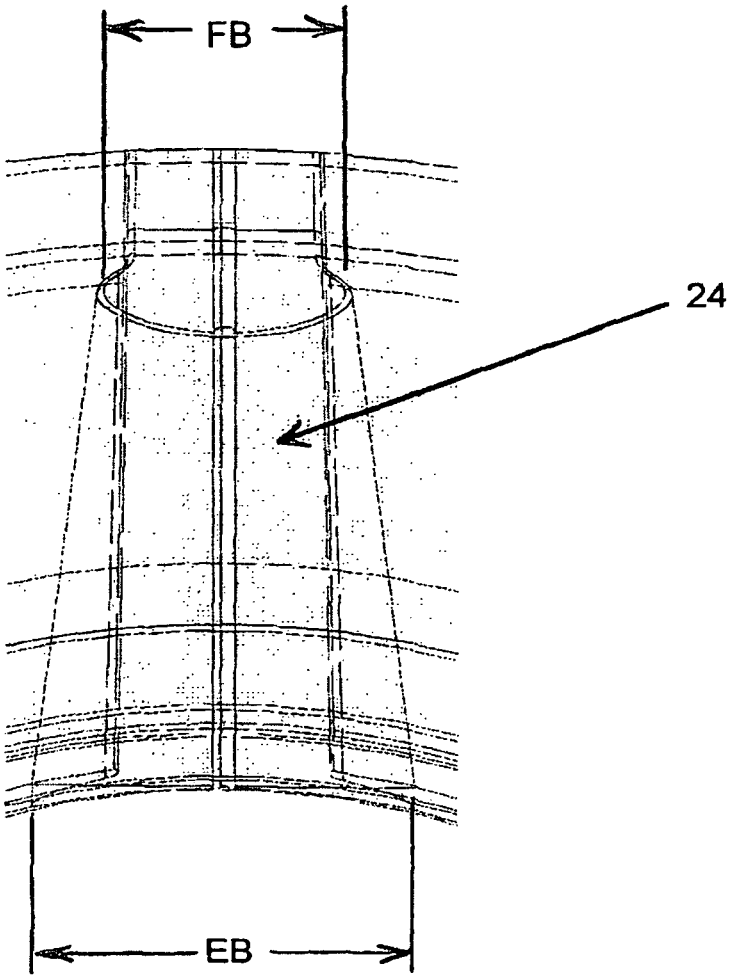
FIG. 13 is a top view of the wheel channel slot.
Figure 14:
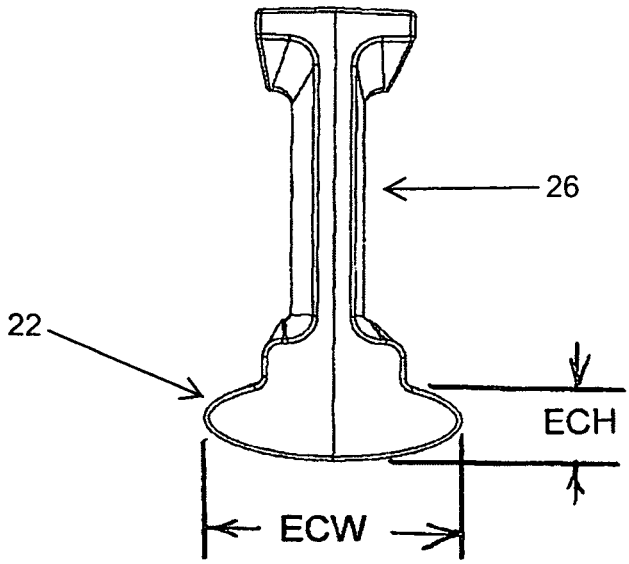
FIG. 14 is a front view of the tenon on the blade of the invention.

The wheel plate channel slot or mortise 24 has an elliptical cross sectional shape in that both the width of and height of the ellipse located at the radially outer end of the channel slot FB is smaller in total area than the radially inner end of the channel slot EB as show in FIG. 8 and FIG. 13. The outer end section FE of the wheel channel slot 24 has a smaller ellipse (in area) that increasingly tapers along its length in a similar elliptical shape on all surfaces toward the inner end of the wheel channel slot BE so that the elliptical cross sectional area at the inner end is greater than at the outer end.

Figure 9:
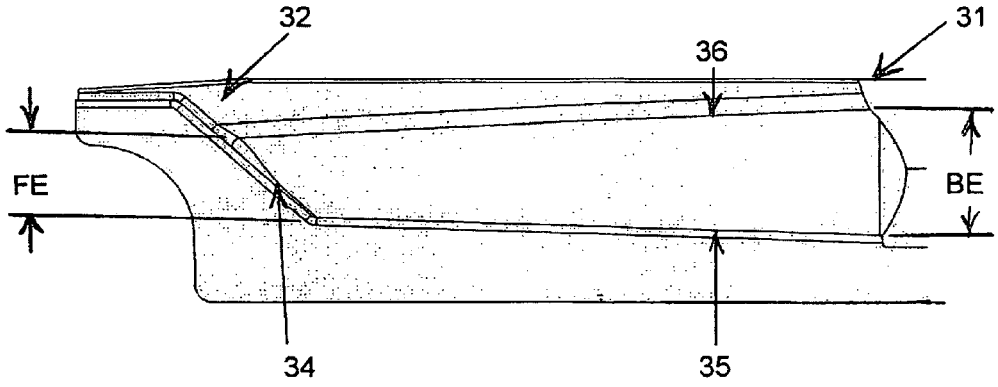
FIG. 9 is a cross section view of the wheel plate channel slot.

FIG. 9 shows the preferred embodiment of the cross section of wheel plate(s) channel 24. The outer end of the wheel plate channel 24 has an acutely angled (preferably about 45°) positive blade stop wall 34 that corresponds to the blade connecting stop member 37 on tenon 22. The cross sectional shape of the wheel channel slot 24 is such that the bottom section and top section of the wheel plate channel slot 24 have arcuate concave surfaces 35 and 36, respectively, which correspond to and slidably mate with the convex bottom surface and convex top surface of the elliptical shape of tenon 22. As the channel slot 24 moves inwardly from the outer end 32 of the wheel plate 25 towards the inner periphery 31 of the wheel plate 25 its total area gradually increases.

Figure 15:
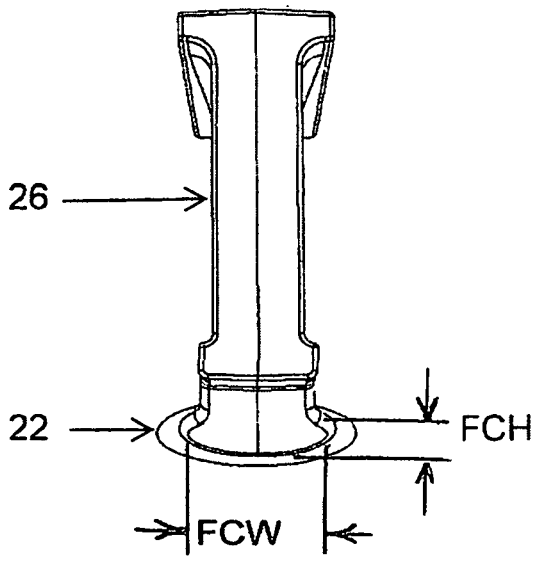
FIG. 15 is an end view of the tenon on the blade of the invention.

The preferred embodiment of the blade connecting member or tenon 22 corresponds to the cross section of the wheel channel slot 24 in that the radially outer width FCW of tenon 22 in FIG. 15 corresponds to the outer end width FB of wheel plate slot 24. The cross sectional shape of the wheel channel slot 24 at the radially inner width EB of the wheel channel slot 24 corresponds to the radially inner width ECW of the tenon 22 of blade 26.

Additionally FIG. 8 shows the height of the blade connecting member or tenon 22 corresponds to the height of the wheel channel cross section along its entire length in that the height of the connecting member 22 is smaller at the outer periphery 32 of the wheel channel slot 24 as FE (FIG. 8) corresponds to FCH (FIG. 15) on the blade connecting member 22. Also, at the inner periphery 31 of the wheel channel slot 24 BE (FIG. 8) corresponds to ECH (FIG. 15) on the blade connecting member or tenon 22.

FIGS. 10-12 illustrate a blade 40 useful in accordance with the present invention with a dual sided wheel plate. Thus, blade 40 has a connecting member or tenon 42 located on each of its opposite edges. Tenons 42 correspond dimensionally in size, shape and cross section to tenon 22 described above with respect to a single wheel plate, and thus need not be further described herein.

In order to assemble the blade 26 and wheel 25, the outer end 29 of the tenon 22 is positioned in alignment with channel 24 at inner periphery 31, and radially inwardly thereof. Tenon 22 is then slid into channel 24 until stop member 37 engages and abuts against stop wall 34. Thereafter, blade 26 may be locked in place in any conventional manner.

Although this disclosure has described and illustrated certain embodiments of the invention, it is to be understood that the invention is not restricted to these particular embodiments but encompass other embodiments that may include functional or mechanical equivalents to features that have been described and illustrated herein.

The embodiments of the invention in which we claim an exclusive property or privilege are defined as follows:

We claim:

1. A centrifugal blasting wheel comprising:

a rotatable annular wheel plate having a radially extending planar face, an inner periphery, an outer periphery, and a plurality of radially extending channels formed in said face and disposed equally spaced circumferentially around the wheel plate;

wherein each channel has an inner end and an outer end and wherein each channel has a cross sectional shape with a width and height such that the width and height of the channel is less at the outer end of the channel than the width and height at the inner end of the channel and each channel further has an arcuate concave shaped bottom surface and an arcuate concave shaped top surface;

a blade releasably disposed in each channel wherein each blade has a connecting member extending radially along one blade edge, said connecting member having a cross sectional shape and taper corresponding to the cross sectional shape and taper of the wheel plate channels; and wherein both the channels in the wheel plate and the connecting members of the blades have an elliptically-shaped cross section extending along the radial length thereof, and both the channels and connecting members are tapered so that their radially inner ends have a greater cross sectional area than their radially outer ends and form a frustum-shaped channel and a frustum-shaped connecting member.

2. The blasting wheel of claim 1 wherein the cross sectional shape of each channel is the same at all locations along the radial length of each respective channel.

3. The blasting wheel of claim 1 wherein there are eight channels equally spaced around the wheel.

4. The blasting wheel of claim 1 wherein each channel has a stop wall at its outer end.

5. The blasting wheel of claim 4 wherein said stop wall is at an acute angle to the radius of each channel.

6. The blasting wheel of claim 5 wherein said acute angle is 45°.

7. The blasting wheel of claim 1 wherein said wheel plate is a single wheel plate.

8. The blasting wheel of claim 1 wherein said wheel plate is a component of a double wheel plate.

9. A blade releasably connected to a wheel plate of a centrifugal blasting wheel, comprising:

a blade member having a side edge;

a connecting member integral with and depending from the side edge of said blade member, said connecting member having an inner end and an outer end and further having a cross sectional shape with a width and height such that the width and height of the connecting member is less at the outer end of the connecting member than the width and height at the inner end of the connecting member;

the connecting member has an arcuate convex shaped bottom surface and an arcuate convex shaped top surface; and wherein the connecting member has an elliptically-shaped cross section extending along the length thereof and is tapered so that its inner end has a greater cross sectional area than its outer end and forms a frustum-shaped connecting member.

10. The blade of claim 9 wherein the cross sectional shape of the connecting member is the same at all locations along its radial length.

11. The blade of claim 9 wherein the connecting member has a stop member at its outer end.

12. The blade of claim 11 wherein said stop member is at an acute angle to the longitudinal length of the connecting member.

13. The blade of claim 12 wherein the acute angle is 45°.

14. The blade of claim 11 wherein the stop member extends from the bottom surface of the connecting member to the side edge of the blade member.

* * * * *